US010287834B2

(12) United States Patent
Chaplin et al.

(10) Patent No.: US 10,287,834 B2
(45) Date of Patent: May 14, 2019

(54) LOGGING TOOL

(71) Applicant: Reeves Wireline Technologies Limited, Leicestershire (GB)

(72) Inventors: Michael John Chaplin, Warwickshire (GB); Simon Christopher Ash, Nottinghamshire (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 28 days.

(21) Appl. No.: 14/976,433

(22) Filed: Dec. 21, 2015

(65) Prior Publication Data

US 2016/0186512 A1 Jun. 30, 2016

(30) Foreign Application Priority Data

Dec. 24, 2014 (GB) ..... 1423205.2

(51) Int. Cl.
*E21B 47/01* (2012.01)
*E21B 23/01* (2006.01)
(Continued)

(52) U.S. Cl.
CPC ..... *E21B 23/01* (2013.01); *E21B 17/1021* (2013.01); *E21B 23/00* (2013.01); *E21B 47/00* (2013.01)

(58) Field of Classification Search
CPC ..... E21B 47/01; E21B 49/06; E21B 49/10; E21B 23/01; E21B 17/1021
See application file for complete search history.

(56) References Cited

U.S. PATENT DOCUMENTS 3,664,416 A 5/1972 Nicolas et al.
3,685,158 A * 8/1972 Planche ..... E21B 17/1021 33/302
(Continued)

FOREIGN PATENT DOCUMENTS

CN 203362080 U 12/2013
CN 103541666 A 1/2014
(Continued)

OTHER PUBLICATIONS

Combined Search and Examination Report in counterpart UK Appl. GB1423205.2, dated Mar. 2, 2015.

*Primary Examiner* — Cathleen R Hutchins
(74) *Attorney, Agent, or Firm* — Blank Rome LLP

(57) ABSTRACT

A logging tool or sub (10) for downhole use comprises an elongate logging tool body (11); one or more moveable reaction members; and a locking member for the reaction members. At least one arm (12) at a first location is pivotably secured to the body (11) to be extensible therefrom and compressible towards the body (11); and at a second location spaced from the first location is pivotably secured to a locking member (18); and a stop member (22) fixed or fixable relative to the body (11). The locking member (18) defines a moveable end (19) remote from the second location and moveable relative to the arm (12) between at least a first position in which force tending to compress the arm (12) towards the body (11) causes the end (19) to move away from the stop member (22), and a second position in which force tending to compress the arm (12) towards the body (11) causes the stop member (22) to resist movement of the locking member (19) thereby preventing compression of the arm (12) towards the body (11). Alternatively, one or more cam and follower arrangement or rack and pinion arrangement can be used.

24 Claims, 7 Drawing Sheets

(51) Int. Cl.

| | |
|---|---|
| ***E21B 23/00*** | (2006.01) |
| ***E21B 47/00*** | (2012.01) |
| ***E21B 17/10*** | (2006.01) |

(56) References Cited

U.S. PATENT DOCUMENTS

| | | | | |
|---|---|---|---|---|
| 4,926,937 | A | 5/1990 | Hademenos | |
| 5,044,437 | A | 9/1991 | Wittrisch | |
| 2005/0263280 | A1* | 12/2005 | Sellers | E21B 23/01 166/255.1 |
| 2008/0257636 | A1 | 10/2008 | Payor | |
| 2009/0071659 | A1 | 3/2009 | Spencer et al. | |
| 2009/0167297 | A1* | 7/2009 | Chee | E21B 47/0905 324/221 |
| 2011/0277990 | A1 | 11/2011 | Kotsonis et al. | |
| 2012/0298378 | A1 | 11/2012 | McCauley et al. | |
| 2013/0104641 | A1 | 5/2013 | Samworth et al. | |
| 2015/0337643 | A1 | 11/2015 | Leach et al. | |

FOREIGN PATENT DOCUMENTS

| | | | |
|---|---|---|---|
| GB | 2300870 | A1 | 11/1996 |
| GB | 2334046 | A | 8/1999 |
| WO | 2013/133890 | A2 | 9/2013 |

* cited by examiner

LOGGING TOOL

FIELD OF THE DISCLOSURE

The invention relates to a downhole logging tool.

BACKGROUND OF THE DISCLOSURE

As is well known, prospecting for minerals, hydrocarbons such as oil and gas, and other natural resources of commercial value is economically an extremely important activity. For various reasons those wishing to extract resources from below the surface of the ground or the floor of an ocean need to acquire as much information as possible about both the potential commercial worth of the natural resources in a geological formation and also any difficulties that may arise in extracting them to surface locations at which they may be used.

Techniques of logging of subterranean formations have developed for the purpose of establishing, with as much accuracy as possible, information as outlined above both before extraction activities commence and also while they are taking place.

During exploratory drilling operations, a hole is drilled from a surface location to a location underground near where the prospective resource is located. The resulting borehole may extend for several thousand or tens of thousands of meters from a surface location.

Drill pipe is typically a hollow, thick-walled, steel piping used on drilling rigs to facilitate the drilling of a borehole/wellbore. Drill pipe consists of numerous pieces, sometimes called "stands", screwed one to another. Each stand is approximately ten meters long. Usually a stand has external male threads at one end and female threads in the internal diameter of the other end. The male threads of one stand are engageable with the female threads of another stand, thereby allowing joining of the stands together.

Normally while borehole drilling is carried out, a compound string of drillpipe stands is used in order to drive a rotatable drill bit mounted at the end of the pipe in contact with the geological formation being drilled.

As the drill bit works its way down into the ground and the borehole length increases, the drill pipe is repeatedly extended by adding new stands to its upper end. As a result long lengths of drillpipe may be inserted into boreholes as they are formed.

Broadly stated, logging involves inserting a logging tool, also known as a sonde, into a borehole or other feature penetrating a formation under investigation; and using the sonde to energize the material of the rock, etc., surrounding the borehole in some way. Such passage of the energy alters its character. The logging tool, that is capable of detecting energy, is intended then to receive emitted energy that has passed through the various components in the rock before being recorded by the logging tool.

Typically the logging tool is formed as an elongate, rigid cylinder that may be e.g. one to five meters long.

Wireline, as is well known in the art, is an armored cable that may be used for the purposes of lowering a logging tool into the borehole, or supporting the tool while it is being withdrawn upwardly along a borehole or well during logging. The logging tool is located at the end of the wireline. Logging measurements are in one known method taken by lowering the wireline including a logging tool attached as aforesaid to a prescribed depth and then raising it out of the well while operating the logging tool. Wireline is capable of electronically telemetering data from various types of logging tool from downhole to surface locations; and also of sending electronic commands to connected downhole equipment. In some situations however it is not possible or desirable to maintain the wireline connected to the logging tool following deployment of the latter.

Wireline drop-off is a conveyance system that allows for openhole data acquisition while tripping (i.e. the act of pulling the drill pipe out of the hole or replacing it in the hole). In this conveyance technique, a logging tool powered by a battery having a memory function is conveyed downhole by wireline through the drill pipe and hangs into the openhole on a no-go at the bottom of the drill pipe.

When drilling has reached total depth (the planned end of the well measured by the length of pipe required to reach the bottom), the wireline is released into the drill pipe. Typically there is a landing collar in the internal wall of the drill pipe, located near the mouth of the final (i.e., most downhole) stand, which receives a landing ring located on and protruding outwardly from the tool. The engagement of the landing ring and collar secures the tool and pipe one to another. When this engagement has occurred, the wireline is removed from the well.

The result of this sequence is that part of the logging tool protrudes beyond the end of the drill pipe and therefore is exposed in a way that permits logging of the formation. A further part of the logging tool remains inside the drill pipe and defines the described landing ring connection to the drill pipe.

To withdraw the drill pipe, the stands at the surface are unscrewed one by one from each other to separate them as the drill pipe is pulled upwardly in discrete steps. As a result the drill pipe is gradually withdrawn from the borehole. A dropped-off logging tool therefore moves towards the surface with the pipe, taking records (well logs) of the formation along the way.

Each time a drill pipe stand is to be removed from the upper end, the withdrawal operation is interrupted while unscrewing of the drill pipe takes place.

The protruding nature of the landing ring on the tool may prevent it from entering drill pipes having a small internal diameter.

Prior art wireline drop-off techniques only enable the tool to log the openhole beyond the landing ring into which the tool protrudes. This limits the length of the openhole where formation data could be acquired. It would be desirable to log openhole that is well beyond the end of the drillpipe.

Sometimes it is desirable to re-log the formation to prove the accuracy and repeatability of the measurements, a technique that is commonplace in conventional wireline logging.

Furthermore, should the drill pipe become stuck in the wellbore a common technique to free it is to rotate and reciprocate the drill pipe. Reciprocation, e.g., moving the pipe up and down, is not possible with logging tools hanging out of the end of the pipe.

SUMMARY OF THE DISCLOSURE

A way to solve the above problems is to have moveable retractable arms which enable the tool to become engaged with a landing surface, if so desired; or allow the tool to go beyond a drill pipe landing ring, into openhole. Such arms do not extend beyond the external cylindrical logging tool body in the retracted position. Consequently the overall external diameter of the logging tool is smaller than in prior art tools having permanently protruding landing parts. This therefore allows the tool to enter and pass through drill pipes that have a small diameter and for the tools to be latched (or re-latched) within the drill pipe using a wireline to latch them at a second position that ensures they do not extend beyond the end of the pipe However, there is a tendency for such arms not to lock in their maximally extended position and hence collapse into a compressed (retracted) position under the influence of e.g. fluid pressure or other forces acting on the arms in the drill pipe. There is therefore a need to improve the stability of the arms in use.

According to a first broad aspect of the invention, there is provided a logging tool or logging tool sub for downhole use comprising an elongate logging tool body; at least one reaction member that is moveable between a retracted position in which it protrudes transversely no further than the extent of the logging tool body and an extended position in which the reaction member protrudes transversely beyond the logging tool body; and a releasable locking mechanism for locking the reaction member in the extended position.

The presence of retractable and extensible reaction members means that the logging tool or logging tool sub advantageously may selectively be caused to land on a landing component, such as a landing ring or shoulder of drillpipe; or pass freely by any such landing feature with the result that the logging tool or logging tool sub may travel beyond the end of drillpipe into open hole. The inclusion of a locking mechanism means the/or each reaction member may selectively be stabilized in use against forces tending to cause the reaction member(s) to retract. This is desirable because a well can kick due to random gas or oil pressure events forcing the logging tools back into the drill pipe. When the latching mechanism reverts to being closed the logging tools will disconnect from the drill pipe.

In some preferred embodiments of the invention the logging tool or logging tool sub includes a plurality of reaction members disposed at mutually spaced locations about the logging tool body. Such an arrangement beneficially permits landing of the logging tool or logging tool sub by way of multiple points of contact with one or more landing features of drill pipe. Such an arrangement is stable and secure.

Preferably the/or each reaction member is drivable at least between the retracted and extended positions by a cam and follower arrangement. In practical embodiments of the invention the/or each reaction member is also drivable in the reverse direction between the extended and retracted positions by way of the cam and follower arrangement.

Also, preferably the/or at least one said reaction member is or includes such a cam follower.

In one embodiment of the invention, the/or each said reaction member is drivable at least between the retracted and extended positions by a rack and pinion arrangement.

Preferably, the or at least one said reaction member is or includes a rack of a said rack and pinion arrangement.

The/or at least one said reaction member optionally may be or include a dog that is engageable with a latching part of a landing component of a section of drill pipe.

Such arrangements are beneficially effective in assisting secure landing of the logging tool or sub.

In another preferred embodiment of the invention, the/or at least one said reaction member is or includes at least one arm that at a first location is pivotably secured to the logging tool body so as to be extensible therefrom and compressible towards the logging tool body, and at a second location spaced from the first location is pivotably secured to a locking member forming part of the locking mechanism; and the locking mechanism further includes a stop member that is fixed or fixable relative to the logging tool body; the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body.

Having moveable retractable arms enables the logging tool to become engaged with a landing surface or allows the tool to go beyond a drill pipe landing ring, into openhole. It is possible to keep the tool in the desired depth by means of the arms that provide stability to the tool. Once the logging tool has reached a desired downhole depth, the apparatus of the invention provides a locking mechanism. This locking mechanism keeps the arms locked in their extended positions even when compressional forces acting on the arms urge them to close back towards the logging tool. The ability of the arms to be maintained in the extended position is therefore also independent of the strength of the driving mechanism of the logging tool system.

Preferably, the logging tool includes a moveable member that is moveable towards and away from the stop member, the moveable end of the locking member being pivotably secured to the moveable member whereby when the locking member adopts the second position force tending to compress the arm towards the logging tool body urges the moveable member into engagement with the stop member.

In a preferred embodiment of the invention, the logging tool body includes a hollow interior accommodating the stop member and the moveable member and the locking member extends via an aperture to interconnect the arm and the moveable member.

Being housed inside the logging tool body, the stop member, the moveable member and the locking member are protected against the downhole environment. Also the exterior dimensions of the logging tool are kept as compact as possible.

Preferably, in the first position, the locking member lies to a first side of a normal to a longitudinal axis of the logging tool body, and in the second position the locking member lies to a second, opposite side of the normal.

It is preferred that the locking member is rigid whereby movement of the locking member between the first and second positions causes the arm to extend from the logging tool body to a maximal extent.

Further, preferably the logging tool body includes a recess within which the arm is receivable when in a compressed position.

In a preferred embodiment of the invention, the pivoting of the arm exposes a surface that is engageable with one or more landing surfaces of a further component.

Conveniently, the engagement of the resulting exposed surface of the arm with a landing surface of a further component causes pressing of the exposed surface and the landing surface together so as to stabilize the arm in an extended position.

Preferably, the logging tool includes a pivot pin through which the arm is pivotably secured to the logging tool body, extending inside the recess.

Also, preferably there are provided three moveable arms each supported by a locking member, at equiangular spacings about a circumference of the logging tool body, which typically is cylindrical.

The inventors have found it desirable to have three moveable landing extensions but the invention is not limited to this number. More or fewer or arrays of moveable landing extensions therefore may be employed, in regular or irregular patterns.

BRIEF DESCRIPTION OF THE DRAWINGS

There now follows a description of preferred embodiments of the invention, by way of non-limiting example, with reference being made to the accompanying drawings in which:

FIGS. 4B and 4C depict a sectional view of the logging tool of FIG. 4A dissected along the line a.

DETAILED DESCRIPTION

Figure 1:
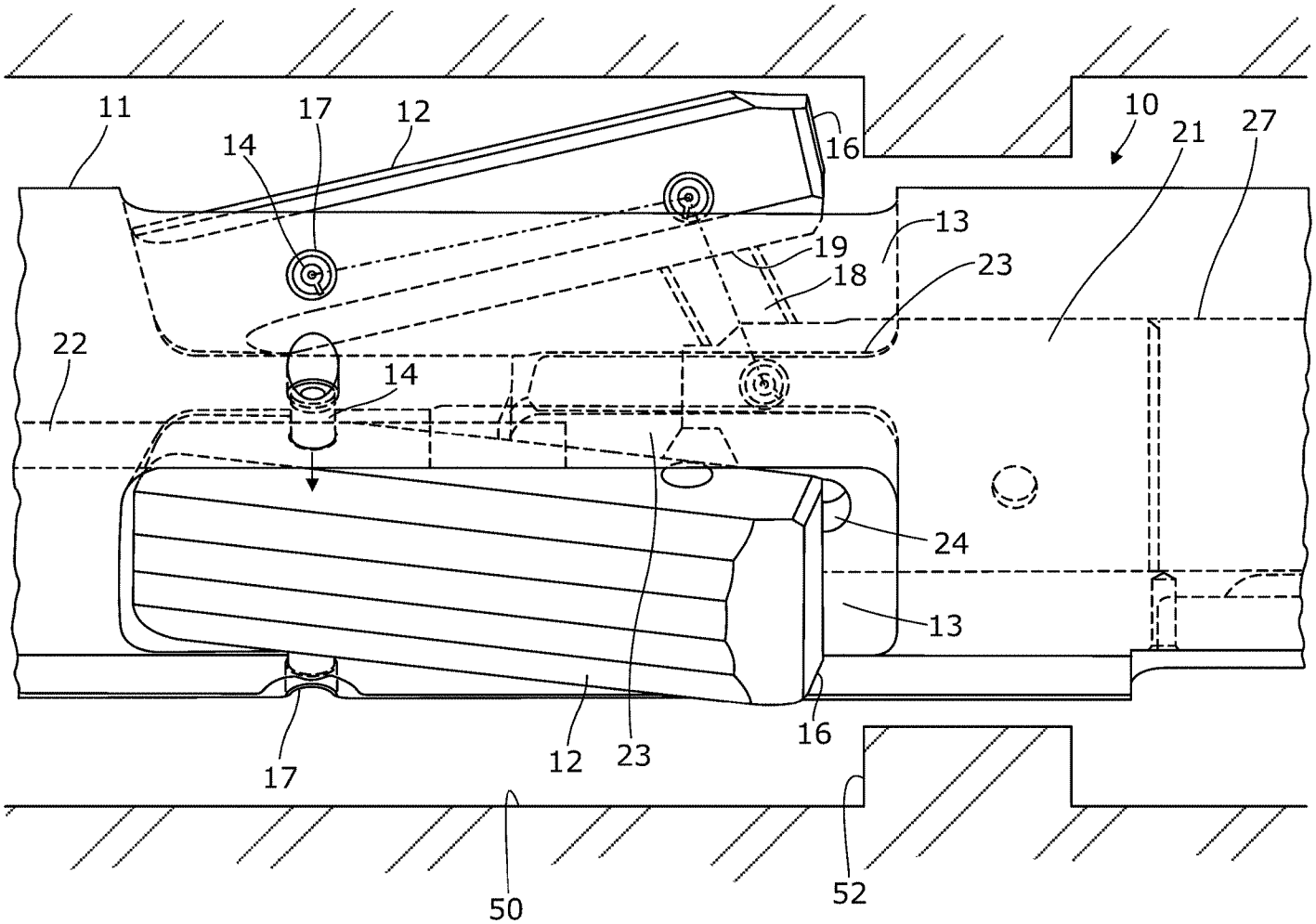
FIG. 1 is a transparent, three-dimensional side view of a logging tool according to the invention inserted into drill pipe and having arms in an extended un-locked position.

FIG. 1 shows, in bold lines, a superimposed schematic representation similar to that depicted in FIGS. 3A to 3J. However, the schematic lines of FIGS. 3A to 3J do not form part of the embodiment of FIG. 1.

Figure 2:
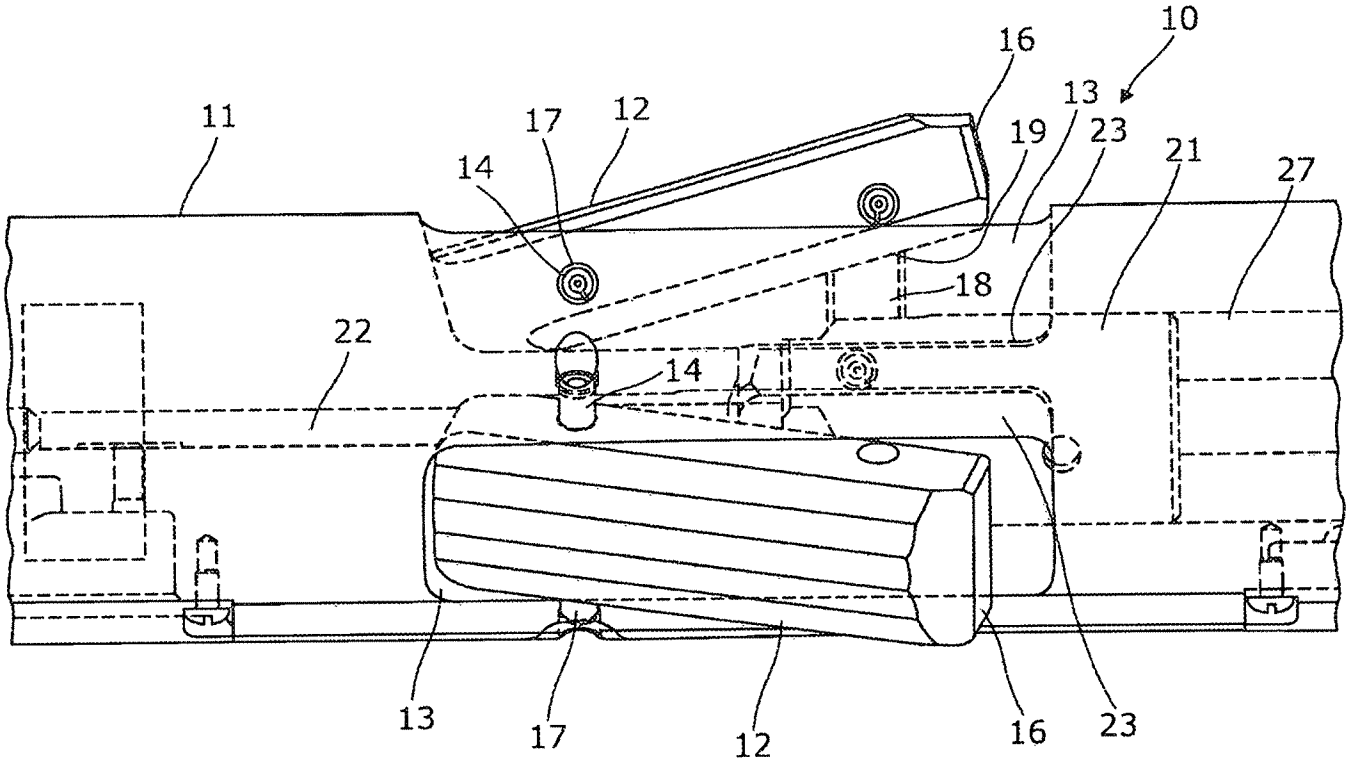
FIG. 2 shows the FIG. 1 arrangement wherein the arms are in a maximally extended locked position.

Referring to FIGS. 1 and 2 of the drawings, there is shown a logging tool or logging tool sub 10 that as is commonly the case has an elongate, hollow cylindrical body 11. Parts of the logging tool 10 intended to energize a subterranean formation or receive logging signals from underground rock are for clarity not shown in the figures. These features may take a wide range of forms that are known to the person of skill in the art.

The cylindrical body 11 of the logging tool 10 supports reaction members that in the illustrated embodiment are three pivotably deployable arms 12 secured on the exterior of the cylindrical body 11 in the manner described below. The presence of retractable and extensible reaction members 12 means that the logging tool 10 or logging tool sub advantageously may selectively be caused to land on a landing component, such as a landing ring or shoulder 52 of drillpipe 50; or pass freely by any such landing feature with the result that the logging tool 10 or logging tool sub may travel beyond the end of drillpipe 50 into open hole.

In the preferred embodiment of the invention shown in FIGS. 1 and 2, three arms 12 are provided equiangularly spaced about the external circumference of the logging tool 10. As a result of the orientation of the logging tool 10 in the figures, only two of the arms 12 are visible.

The arms 12 lie near to the in-use uphole end of the logging tool 10 so that a major part of the length of the tool 10 extends in a downhole direction from the circumference at which the arms 12 are secured. This feature is of benefit when deploying the tool 10 in a drop-off (or similar "tool hanging") manner so that part of the tool protrudes beyond the open end of drill pipe 50 in a borehole (not shown).

However, other numbers and patterns of the arms 12 are possible within the scope of the invention. It is not essential that the arms 12 are equiangularly spaced about a circumference of the tool 10, or that they are secured at a common circumference. Indeed, various irregular patterns of the arms 12 are possible but the regular arrangement shown is preferred because (a) it permits even accommodation of forces when the arms 12 engage a drill pipe landing ring 52; and (b) landing of the tool 10 may be effected reliably and repeatably as a result.

The arms 12 are elongate, essentially rectangular members that extend parallel to the longitudinal axis of the logging tool 10. As shown in FIG. 1, the arms 12 are received within respective essentially rectangular recesses 13 that are aligned in register with the arms 12 and are dimensioned so that the arms 12 are neatly receivable retracted inside in them. The depth of each recess 13 is such that when the arms 12 are in the retracted position they protrude outwardly no further than the material of the cylindrical body 11, and in preferred embodiments of the invention lie flush with the exterior of the body 11. In FIG. 1, however, the arms are illustrated in a slightly different position and are only partly retracted.

At its in-use, uphole end each recess 13 includes secured therein a transversely extending pivot pin 14 that extends across the recess from one major side to the other, opposite side.

Each pivot pin 14 perforates one of the arms 12 near its uphole end and retains it pivotably captive relative to the cylindrical body 11. The dimensions of the parts are such that the arms 12 may pivot between a compressed position and an extended position. As a result of pivoting about the pivot pins 14, the uphole ends of the arms 12 retract slightly into the associated recesses 13 and the downhole ends protrude noticeably beyond the exterior of the cylindrical body 11.

The in-use, most downhole ends of the arms 12 are formed as exposed surfaces 16 that are engageable with drill pipe landing rings 52 of conventional designs.

As illustrated, the pivot pins 14 are secured in chord bores 17 formed in the material of cylindrical body 11. Each pivot pin 14 may be e.g., a press fit at either end in a pair of such chord bores 17, so that the pivot pin 14 spans the recess 13 in which it is fixed from one major side to the other. However, other methods of securing the pins 14 are possible within the scope of the invention.

Near the exposed surface 16 at one end of each arm 12, there is pivotally connected one end of a moveable locking member 18. The other end 19 of the locking member 18 is pivotally fixed to a moveable member 21.

In a preferred embodiment of the invention, the locking member 18 is made of rigid materials but the invention is not limited as such.

Thus, it is possible for example for one or more of the locking members 18 to be resiliently deformable (e.g., through the incorporation of a spring-biased hinge mid-way between its ends). Such a locking member would resist forces tending to compress the arms 12 into the recesses 13 up to a limit determined by the spring force acting at the hinge. A compressive force exceeding the resilience of the locking member 18 then would cause the arms 12 to adopt the retracted position even when they are locked as described below.

Within the hollow interior of the logging tool 10, an elongate stop member 22 additionally extends along the longitudinal axis of the body 11. Stop member 22 in the illustrated embodiment of the invention is formed as an elongate, fixed rod one free end of which is engageable by the moveable member 21. In other embodiments, however, the stop member 22 may take other forms.

Moveable member 21 lies inside, and is longitudinally moveable along, a hollow bore 27 extending inside the body 11 of the logging tool 10 parallel to its longitudinal axis. In the preferred embodiment shown the bore 27 is concentric with the cylinder that is the logging tool body 11; but in other embodiments of the invention this need not necessarily be the case, and e.g., an off-center moveable member may be used.

The moveable member 21 preferably is essentially cylindrical as illustrated but this need not necessarily be the case, and other cross-sections are possible. In such cases the cross-section of the hollow bore 27 may be altered accordingly.

The moveable member 21 as illustrated is slideably moveable inside the hollow bore 27. In other embodiments of the invention, however, movement of the moveable member 21 may be effected through a phenomenon other than sliding. Furthermore, it is not strictly necessary that movement of the moveable member 21 is longitudinal relative to the logging tool body 11. Thus, it is possible to envisage variants of the invention in which e.g. rotational movement of the moveable member 21 is possible. In such an arrangement, it may be desirable for the locking members 18 not to be permanently connected to the moveable member 21. Examples of such variants are described below with reference to FIGS. 4 and 5.

As a result of the pivotable connections at the ends of the locking members 18, the latter are moveable as the arms 12 and moveable member 21 move.

Furthermore, as noted, the moveable member 21 lies inside the interior of the logging tool body 11 whereas the pivotable connection of each locking member 18 and its associated arm 12 lies in a recess 13, externally of the logging tool body 11.

In order to accommodate both the connection between each arm 12 and the moveable member 21 a respective, through-going perforation 23 is formed in the walls of each recess 13. In the embodiment illustrated each perforation is in the form of an elongate slot that extends parallel to the center axis of the logging tool body 11. In other arrangements however other shapes of the perforations are possible.

Depending on the sizes and shapes of (in particular) the recesses 13, the perforations 23 and the moveable member 21, one or more parts of the moveable member 21 may at certain points in its range of movement protrude via the perforations 23 into the recesses. In the embodiment of the invention illustrated in FIGS. 1 and 2, however, the ends of moveable member 21 at which the locking members 18 attach are shaped, e.g. flattened, so as to avoid protrusion of the moveable member 21 via the perforations 23.

Regardless of whether the moveable member 21 protrudes as described, it is advantageous for each pivotable connection of a locking member 18 to the moveable member 21 optionally to lie as shown inside a respective further recess 24 formed in the surface of the moveable member 21. This protects the pivot against damage and assists the member 21 to move freely inside the logging tool body 11.

FIGS. 3A to 3J illustrate, by way of schematic drawings, the movement of the arms 12 when the moveable member 21 moves in direction X (i.e. from right to left). Such movement of the moveable member 21 may be effected in a variety of ways as will be known to the person of skill in the art.

Figure 3A:
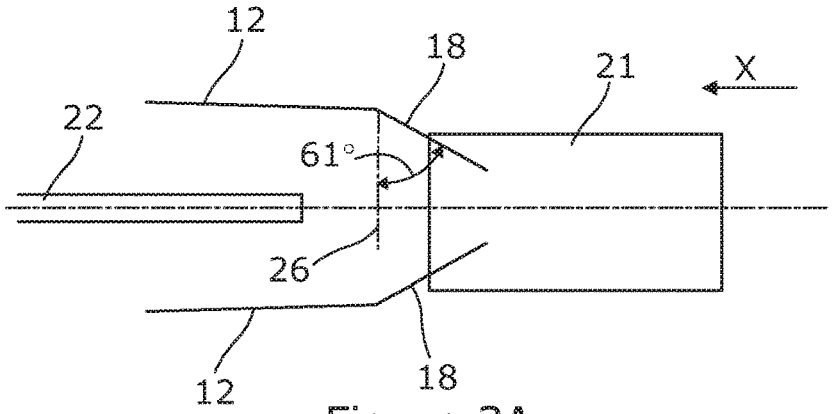
FIGS. 3A to 3J form a series of schematic drawings showing how movement of the locking member locks the arms in a maximally extended position.
Figure 3B:
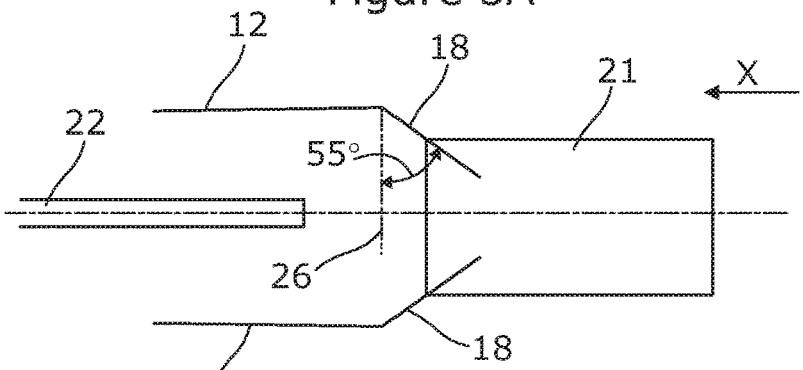
Figure 3C:
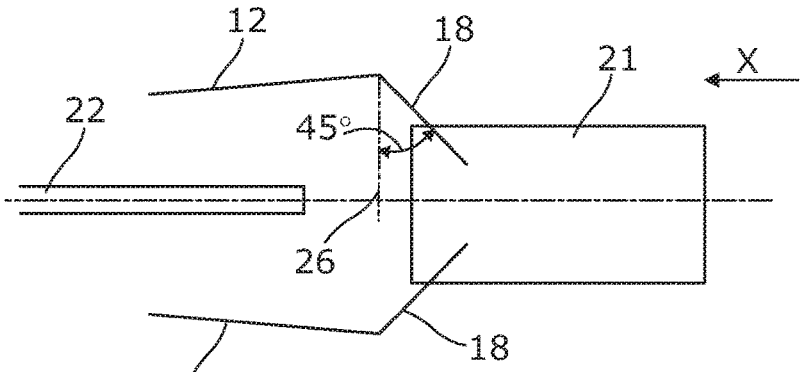
Figure 3D:
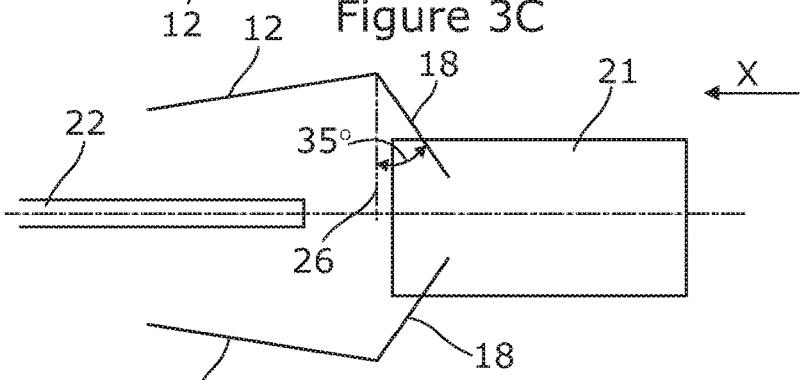
Figure 3E:
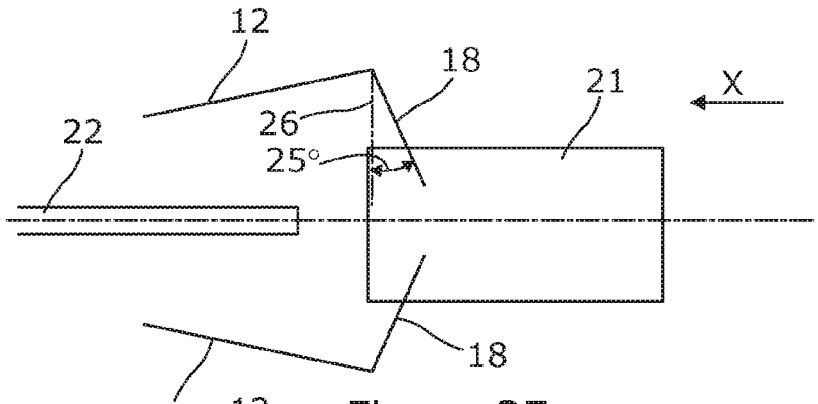
Figure 3F:
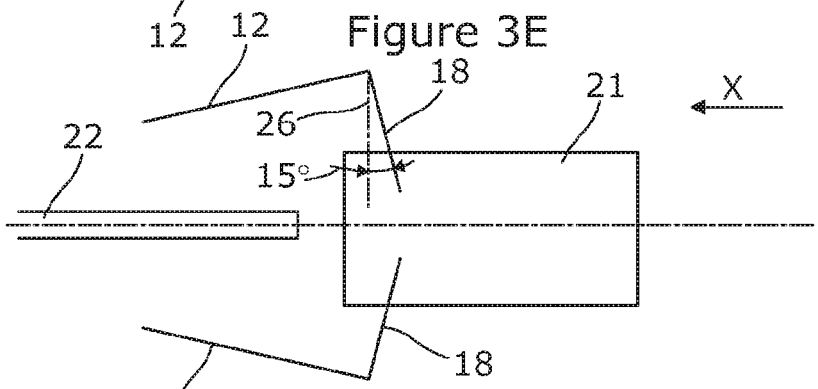

FIG. 3A shows the locking member 18 initially forming an angle of 61° (in the preferred embodiment described, although this choice of starting position may be varied within the scope of the invention) with a normal 26 to the longitudinal axis of the logging tool on one side. The size of the angle is for illustration purposes and the angle formed, as depicted in FIGS. 3A to 3J, can range from 0° to 90°.

As the moveable member 21 moves to the left, the arm 12 pivots away from the logging tool 10 and the angle between the locking member 18 and the normal 26 decreases.

Figure 3G:
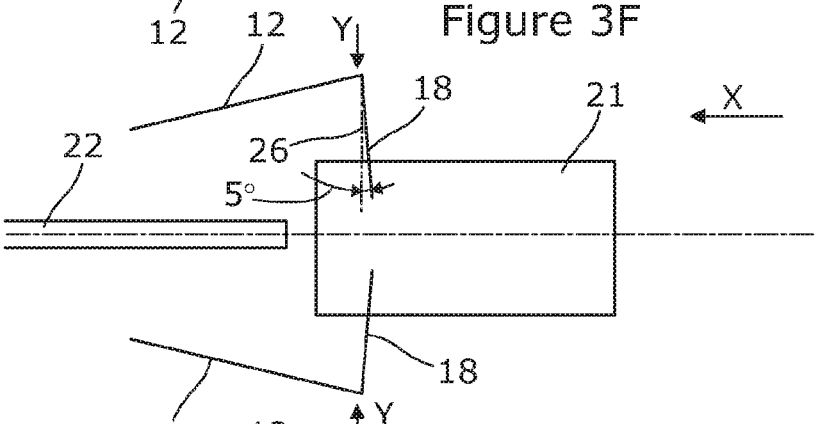

When the position of the moveable member 21 is as illustrated in any of FIGS. 3A to 3G, any force acting on the arms 12 as shown by arrow Y in FIG. 3G, which tends to urge the arm 12 to close (towards the logging tool), causes the moveable member 21 to slide to the right. The logging tool 10 would, therefore, not be stable at such a time.

Figure 3H:
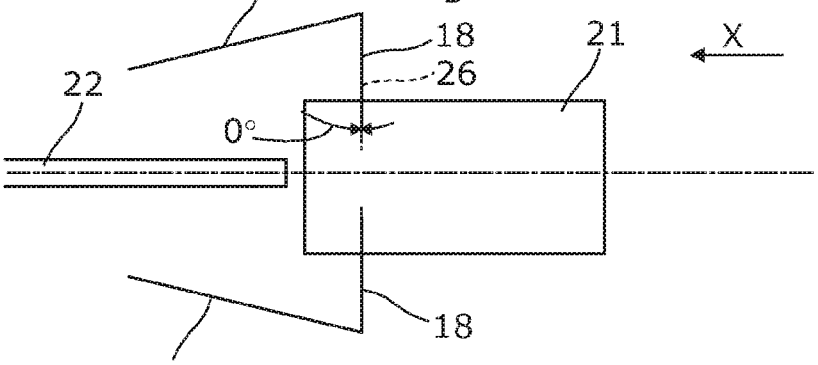

When the angle has decreased to zero, as shown in FIG. 3H (which approximately corresponds to the FIG. 2 component positions), this signifies that the arm 12 is at its maximum opening and will not pivot further. In this configuration any compressive forces acting on the arms 12 will act longitudinally along the locking members 18 with the result that the compression will be resisted. The moveable member 21 is however not in contact with the stop member 22 and can continue to move to the left.

Figure 3I:
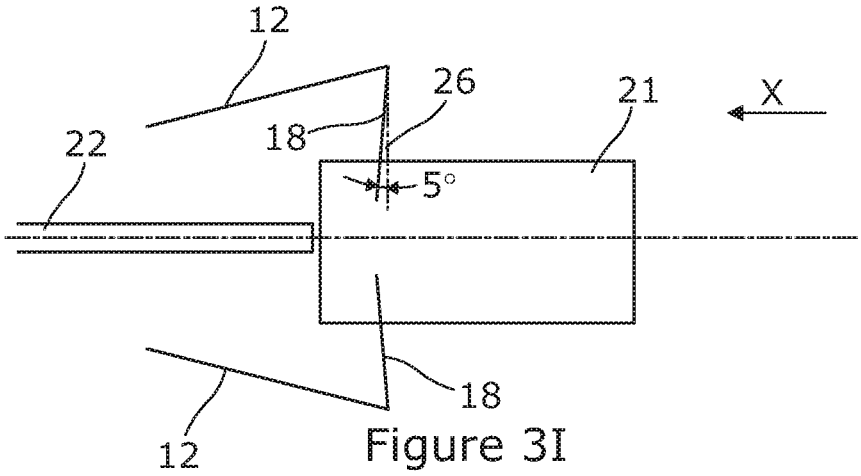

Movement of the moveable member 21 further to the left, after the arms 12 have reached their maximum opening, causes the locking member 18 to pass the normal 26 and lie on the opposite side of the normal 26 to its starting position. This configuration is shown in FIG. 3I. At this time any compressive force acting on the arms 12 drives the moveable member 21 further to the left.

Continued movement of the moveable member 21 in direction X finally brings it into contact with the stop member 22 which then inhibits further movement of the moveable member 21 to the left. In this position, any force that pushes on the arms 12 (e.g. Force Z in FIG. 3J) cannot cause the moveable members 18 to pass the normal 26 in the opposite direction. In other words, the arms 12 will not compress back towards the logging tool 10, and neither will the locking member 18 move to the right. Instead, the moveable member 21 is pressed against the stop member 22 and the arms 12 are locked in place.

Figure 3J:
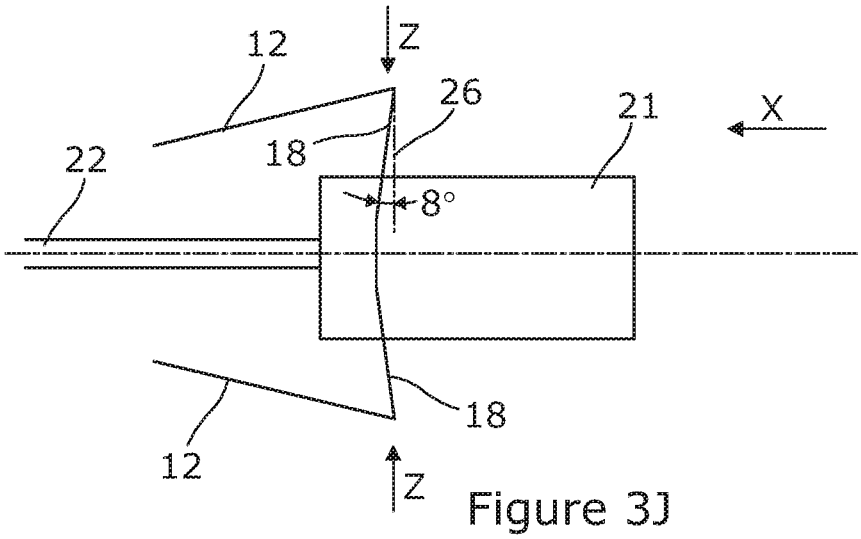

As can be seen above, the engagement of the moveable member 21 and the locking members 18, when the arms 12 are in the position as illustrated in FIGS. 3H and 3J, provides an axial force that locks the arms 12. The mechanism of the invention may be restored to a configuration permitting compression of the arms 12 into the recess 13 by driving the moveable member 21 to the right (as referenced in FIGS. 3A to 3J).

The person of skill in the art is aware of techniques for causing such movement of the moveable member 21, which in turn draws the locking members 18 to pass the normal 26 in the opposite (i.e. return) direction. This brings the apparatus to one of the configurations illustrated in FIGS. 3A to 3G. Receipt of the arms 12 into the recess 13 is then possible, either as a result of compressive forces acting on the arms 12 from the exterior of the logging tool 10 or because of further, powered movement of the moveable member 21 to the right in the schematic figures.

Alternative embodiments of the invention include one or more cam and follower arrangements for effecting movement of one or more reaction members. In such an embodiment the reaction members, which do not have to be embodied as pivoting arms, may include the followers of the cam and follower arrangement.

An embodiment of the invention having a cam and follower arrangement will now be described with reference to FIGS. 4A to 4C.

Figure 4A:
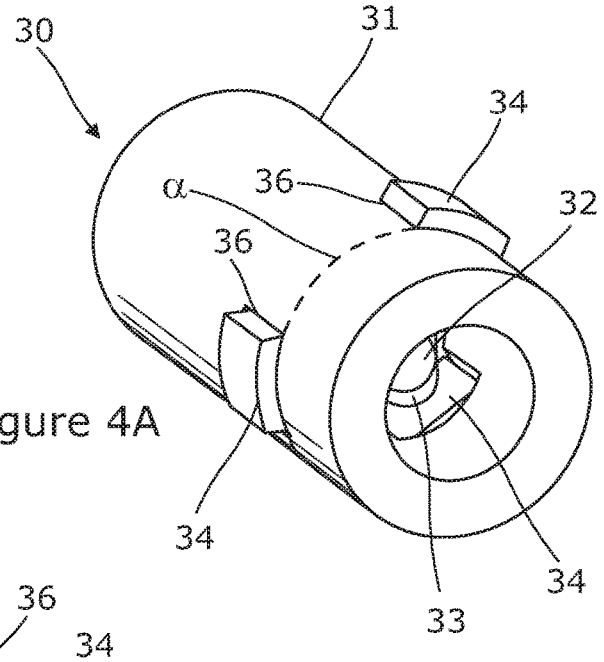
FIG. 4A is a three-dimensional perspective view of a logging tool according to an embodiment of the invention having a cam and follower arrangement.

In FIG. 4A, there is shown a logging tool or logging tool sub 30 that as is commonly the case has an elongate, hollow cylindrical body 31. Reaction members 34 of the logging tool 31 as illustrated in FIG. 4A are in their extended positions.

Figure 4B:
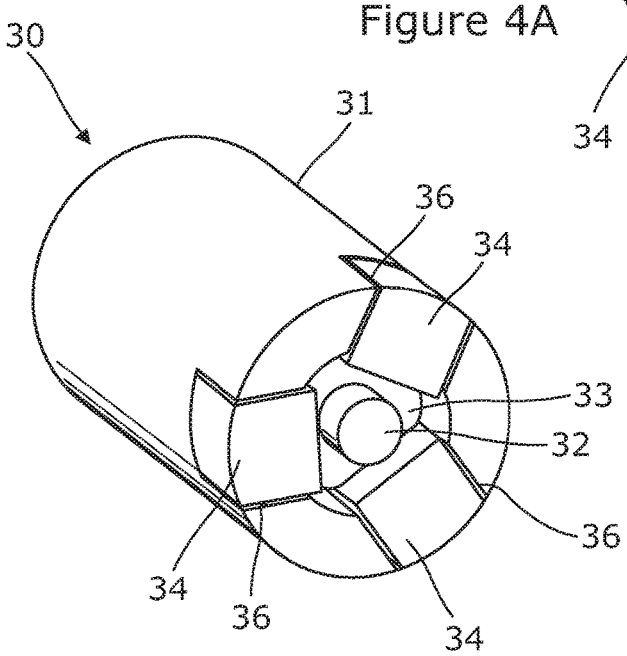
Figure 4C:
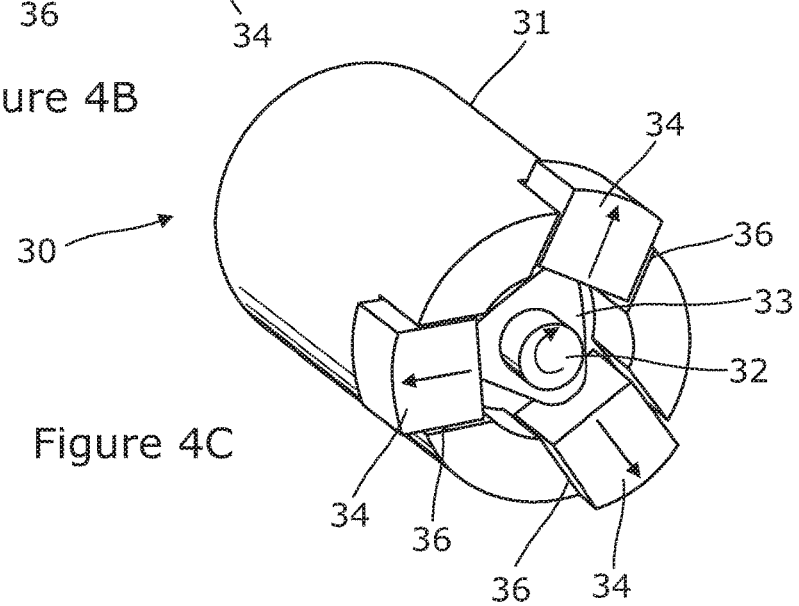

The cam and follower arrangement can be seen in FIGS. 4B and 4C, after the logging tool 30 depicted in FIG. 4A is dissected along the cutting line a and a front portion of the tool 30 is removed.

Inside the cylindrical body 31 there is a rotatable shaft 32 that has fixedly mounted thereon, and rotationally drives a triangular element 33 with truncated corners defining three lobes that are separated from one another by the sides of the generally triangular shape of the element 33. The lobs and sides together define a continuous cam surface extending about the periphery of the triangular element 33. The element 33 need not be triangular, however, and can be in other forms and shapes.

In the illustrated embodiment, there are three reaction members 34, the reaction members 34 being equiangularly spaced within the cylindrical body 31. There are three corresponding perforations 36 in the cylindrical body 31 which allow the reaction members 34 as desired partially to protrude beyond the surface of the cylindrical body 31 and retract within it. The number of reaction members and perforations in the scope of the invention is not limited to three, but this is the preferred member as it provides for good stability of landing of the logging tool 30.

Each reaction member 34 has an inner end that contacts the triangular element 33, and an outer end that when the reaction members are retracted as shown in FIG. 4B lies flush with and forms part of the surface of the cylindrical body 31. When the reaction members 34 are in the retracted position as shown in FIG. 4B, inner end of each reaction member 34 lies flush with the surface of the cylindrical body 31; and the bottom half of each reaction member 34 sits on a side of the triangular element 33.

When the shaft 32 rotates, the triangular element 33 rotates and the sliding motion of the triangular element 33 is converted into an outward linear force that pushes the reaction members 34 to protrude beyond the cylindrical body 31. The reaction members as a result attain their extended positions as shown in FIG. 4C. The inner end of each reaction member 34 no longer sits on a side edge of the triangular element 33, and is instead abutted by a truncated corner lobe of the triangular element 33.

The reaction members 34 will remain in their extended positions, with their outer ends protruding out of the surface of the cylindrical body 31, as long as each truncated corner lobe of the triangular element 33 continues to support the inner end of each reaction member 34. The reaction members 34 are hence locked in place.

The reaction members are spring-biased towards the retracted position of FIG. 4B. As a result when the triangular cam element 33 rotates further the inner (follower) ends of the reaction members 34 bear against the sides of the triangular profile of the element 33. In consequence the reaction members 34 are able to retract under the influence of the spring biasing.

Various techniques for commanding movement of the rotation of the shaft 32 even when the logging tool/sub 30 is far downhole are known in the logging tool art.

Alternative embodiments of the invention include one or more rack and pinion arrangements for effecting movement of one or more reaction members.

An embodiment of the invention having a rack and pinion arrangement will now be described with reference to FIGS. 5A to 5C.

Figure 5A:
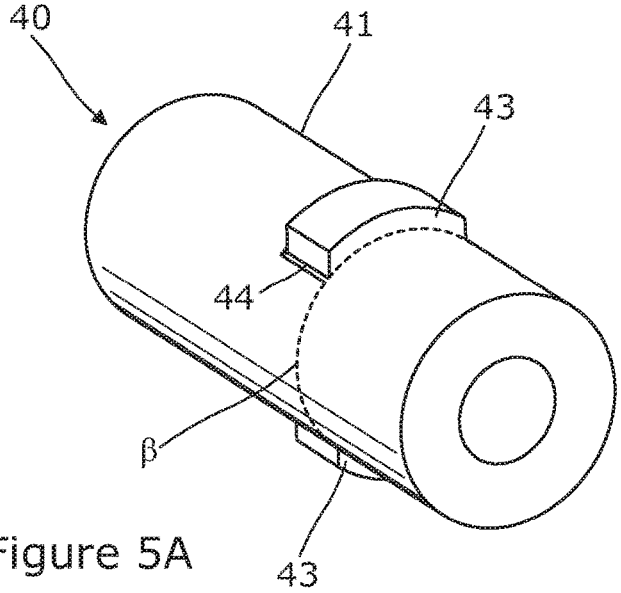
FIG. 5A is a three-dimensional perspective view of a logging tool according to an embodiment of the invention having a rack and pinion arrangement.

FIG. 5A shows a logging tool or logging tool sub 40 that as is commonly the case has an elongate, hollow cylindrical body 41. The reaction members of the logging tool 41 as illustrated in FIG. 5A are in their extended positions.

Figure 5B:
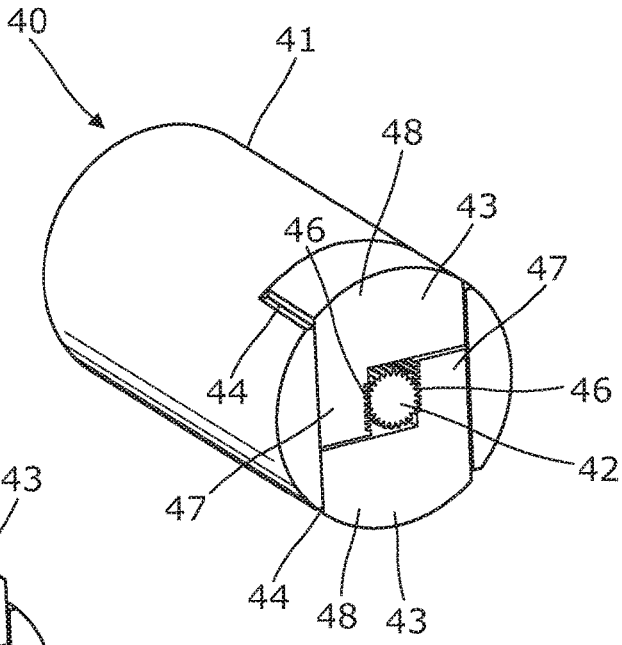
FIGS. 5B and 5C depict a sectional view of the logging tool of FIG. 5A dissected along the line R.
Figure 5C:
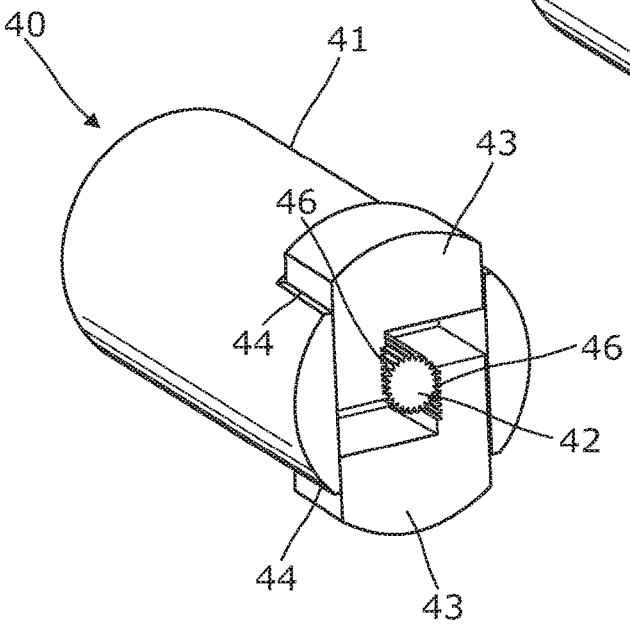

The rack and pinion arrangement can be seen in FIGS. 5B and 5C, after the logging tool 40 depicted in FIG. 5A is dissected along the cutting linep and a front portion of the tool 40 is removed.

Centrally mounted inside the cylindrical body 41 is a rotatable shaft 42 with a toothed outer periphery 42 defining a pinion.

In the illustrated embodiment, there are two P-shaped reaction members 43. The scope of the invention however includes more or fewer of reaction members 43 that could be of various shapes and forms.

There are two perforations 44 in the cylindrical body which correspond to the positions of the reaction members 43 and allow them to protrude beyond the surface of the cylindrical body 41.

Each P-shaped reaction member 43 is made up of a curved upper portion 48 that lies flush with the surface of the cylindrical body 41 when the reaction member 43 is in a retracted position. Each reaction member 43 has a perpendicular straight limb 47 a side of which facing the shaft 42 comprises teeth 46. The teeth 46 meshingly engage with the teeth of the rotatable shaft 42. The aforesaid sides of the straight limbs 47 constitute rack members and lie facing one another on opposite sides of the shaft 42. The arrangement of the reaction members means they are capable of protruding as described below on opposite sides of the cylindrical body 41.

As a result of engagement between the pinion teeth of shaft 42 and the rack teeth 46, clockwise rotational motion of the shaft 42 is converted to linear motion of the reaction members 43 whereby in the illustrated embodiment as depicted in FIG. 5C, the reaction members 43 move outwards in opposite directions away from each other.

FIG. 5C depicts the logging tool 40 when the reaction members 43 are in their extended positions. As long as the rack teeth 46 on the straight limb 47 engage with the teeth on the shaft (pinion) 42, the reaction members 43 are locked in their extended positions.

Rotation of the shaft in the anticlockwise direction causes retraction of the reaction members 43. When this is effected, the upper portions 48 move until they lie flush with the outer surface of the cylindrical body 41. In this position, the free end of each straight limb 47 abuts the underside of the upper portion 48 of the other reaction member 43. As a result, retraction of the reaction members 43 is limited to the position shown, and the reaction members 43 do not become recessed relative to the cylindrical body 43.

The interior of the cylindrical body 43 is hollowed to permit such movement of the described components.

As mentioned above, several methods for commanding movement of the rotation of the shaft 42 even when the logging tool/sub 40 is far downhole are known in the logging tool art.

In the embodiment of FIGS. 5A to 5C, the reaction members 43 are aligned with each other lengthwise along the cylindrical body. This need not necessarily be the case however; and it is possible for the reaction members to be longitudinally spaced from one another along the cylindrical body 41.

In the various embodiments described above, the reaction members, or at least their in-use free ends, may be constituted as dogs that may latch or otherwise engage with landing features.

Numerous means may be employed, within the scope of the invention, for causing the reaction members to extend transversely with respect to the elongate dimension of the logging tool or sub.

The listing or discussion of an apparently prior-published document in this specification should not necessarily be taken as an acknowledgement that the document is part of the state of the art or is common general knowledge.

Preferences and options for a given aspect, feature or parameter of the invention should, unless the context indicates otherwise, be regarded as having been disclosed in combination with any and all preferences and options for all other aspects, features and parameters of the invention.

The invention claimed is:

1. An assembly for downhole use with a section of drill pipe, the assembly comprising:

a landing component disposed on the section of drill pipe and having a landing shoulder; and a logging tool or logging tool sub for downhole use comprising:

an elongate logging tool body;

at least one reaction member that is moveable between a retracted position in which the at least one reaction member protrudes transversely no further than the extent of the logging tool body and an extended position in which the at least one reaction member protrudes transversely beyond the logging tool body; and a releasable locking mechanism for locking the at least one reaction member in the extended position, wherein each of the at least one reaction member is secured to the logging tool or logging tool sub at a circumference of the logging tool or logging tool sub such that in use a major part of a length of the logging tool or logging tool sub extends in a downhole direction from the circumference; and wherein the at least one reaction member comprises a dog that is engageable with the landing shoulder of the landing component disposed on the section of drillpipe.

2. The assembly according to claim 1, including a plurality of said at least one reaction member disposed at mutually spaced locations about the logging tool body.

3. The assembly according to claim 1, wherein each of said at least one reaction member is drivable at least between the retracted and extended positions by a cam and follower arrangement.

4. The assembly according to claim 1, wherein each of said at least one reaction member is drivable at least between the retracted and extended positions by a cam and follower arrangement; and wherein at least one of said at least one reaction member is a cam follower.

5. The assembly according to claim 1, wherein each of said at least one reaction member is drivable at least between the retracted and extended positions by a rack and pinion arrangement.

6. The assembly according to claim 1, wherein each of said at least one reaction member is drivable at least between the retracted and extended positions by a rack and pinion arrangement; and wherein at least one of said at least one reaction member comprises a rack of said rack and pinion arrangement.

7. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism; and wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body.

8. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body; and including a moveable member that is moveable towards and away from the stop member, the moveable end of the locking member being pivotably secured to the moveable member whereby when the locking member adopts the second position force tending to compress said arm towards the logging tool body urges the moveable member into engagement with the stop member.

9. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body;

including a moveable member that is moveable towards and away from the stop member, the moveable end of the locking member being pivotably secured to the moveable member whereby when the locking member adopts the second position force tending to compress said arm towards the logging tool body urges the moveable member into engagement with the stop member;

wherein the logging tool body includes a hollow interior accommodating the stop member and the moveable member; and wherein the locking member extends via an aperture to interconnect the arm and the moveable member.

10. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body;

wherein in the first position the locking member lies to a first side of a line normal to a longitudinal axis of the logging tool body; and wherein in the second position the locking member lies to a second, opposite side of the said line normal to the longitudinal axis of the logging tool body.

11. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body; and wherein the locking member is rigid whereby movement of the locking member between the first and second positions causes said arm to extend from the logging tool body to a maximal extent.

12. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body; and wherein the logging tool body includes a recess within which said arm is receivable when in a compressed position.

13. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body; and wherein the pivoting of said arm exposes a surface that is engageable with one or more landing surfaces of a further component.

14. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body;

wherein the pivoting of said arm exposes a surface that is engageable with one or more landing surfaces of a further component; and wherein engagement of the exposed surface of the arm with the landing surface of a further component causes pressing of the exposed surface and the landing surface together so as to stabilize the arm in an extended position.

15. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body;

wherein the pivoting of said arm exposes a surface that is engageable with one or more landing surfaces of a further component;

wherein engagement of the exposed surface of the arm with the landing surface of a further component causes pressing of the exposed surface and the landing surface together so as to stabilize the arm in an extended position; and including a pivot pin, through which the arm is pivotably secured to the logging tool body, extending inside the recess.

16. The assembly according to claim 1, wherein at least one of said at least one reaction member comprises at least one arm that at a first location is pivotably secured to the logging tool body so as to be extensible therefrom and compressible towards the logging tool body; and at a second location spaced from the first location is pivotably secured to a locking member forming part of the locking mechanism;

wherein the locking mechanism further includes a stop member that is fixed or fixable relative to the logging tool body, the locking member defining a moveable end that is remote from the second location and is moveable relative to the arm between at least a first position in which force tending to compress the arm towards the logging tool body causes the moveable end to move away from the stop member, and a second position in which force tending to compress the arm towards the logging tool body causes the stop member to resist movement of the locking member thereby preventing compression of the arm towards the logging tool body; and including three said moveable arms each supported by said locking member at equiangular spacings about a circumference of the logging tool body.

17. A logging tool or logging tool sub for downhole use with a landing component of a section of drillpipe, the tool or sub comprising:

an elongate logging tool body having a longitudinal axis;

at least one reaction arm that is moveable between a retracted position in which the at least one reaction arm protrudes transversely no further than the extent of the logging tool body and an extended position in which the at least one reaction arm protrudes transversely beyond the logging tool body, the at least one reaction arm in the extended condition extending in a downhole direction at a first acute angle relative to the longitudinal axis, the at least one reaction arm having a distal end that is engageable with the landing component of the section of drillpipe; and a releasable locking mechanism for locking the at least one reaction arm in the extended position, the releasable locking mechanism comprising at least one locking arm pivotably connected to the at least one reaction arm, the at least one locking arm pivoting past normal relative to the at least one reaction arm and extending in the downhole direction at a second acute angle relative to the longitudinal axis.

18. The logging tool or logging tool sub according to claim 17, including a plurality of the at least one reaction arm disposed at mutually spaced locations about the logging tool body.

19. The logging tool or logging tool sub according to claim 17, wherein the at least one reaction arm at a first location is pivotably secured to the logging tool body so as to be extensible therefrom and compressible towards the logging tool body; and at a second location spaced from the first location is pivotably secured to the at least one locking arm forming part of the locking mechanism; and wherein the locking mechanism further includes a stop member that is fixed or fixable relative to the logging tool body, the at least one locking arm defining a moveable end that is remote from the second location and is moveable relative to the at least one reaction arm between at least a first position in which force tending to compress the at least one reaction arm towards the logging tool body causes the moveable end to move away from the stop member, and a second position in which force tending to compress the at least one reaction arm towards the logging tool body causes the stop member to resist movement of the at least one locking arm thereby preventing compression of the at least one reaction arm towards the logging tool body.

20. The logging tool or logging tool sub according to claim 19, including a moveable member that is moveable towards and away from the stop member, the moveable end of the at least one locking arm being pivotably secured to the moveable member, whereby when the at least one locking arm adopts the second position force tending to compress the at least one reaction arm towards the logging tool body urges the moveable member into engagement with the stop member.

21. The logging tool or logging tool sub according to claim 20, wherein the logging tool body includes a hollow interior accommodating the stop member and the moveable member; and wherein the at least one locking arm extends via an aperture to interconnect the at least one reaction arm and the moveable member.

22. The logging tool or logging tool sub according to claim 19, wherein in the first position the at least one locking arm lies to a first side of a line normal to the longitudinal axis of the logging tool body; and wherein in the second position the at least one locking arm lies to a second, opposite side of the said line normal to the longitudinal axis of the logging tool body.

23. The logging tool or logging tool sub according to claim 17, wherein the logging tool body includes a recess within which the at least one reaction arm is receivable when in a compressed position; and including a pivot pin, through which the at least one reaction arm is pivotably secured to the logging tool body, extending inside the recess.

24. The logging tool or logging tool sub according to claim 17, wherein the pivoting of the at least one reaction arm exposes a surface that is engageable with one or more landing surfaces of a further component.

* * * * *